US009884364B2

(12) United States Patent
Abe et al.

(10) Patent No.: US 9,884,364 B2
(45) Date of Patent: Feb. 6, 2018

(54) MOLDING APPARATUS

(71) Applicant: Toshiba Kikai Kabushiki Kaisha, Chiyoda-ku, Tokyo (JP)

(72) Inventors: Yuji Abe, Fujisawa (JP); Saburo Noda, Astugi (JP); Toshiaki Toyoshima, Zama (JP)

(73) Assignee: TOSHIBA KIKAI KABUSHIKI KAISHA, Chiyoda-ku, Tokyo (JP)

( * ) Notice: Subject to any disclaimer, the term of this patent is extended or adjusted under 35 U.S.C. 154(b) by 197 days.

(21) Appl. No.: 14/789,651

(22) Filed: Jul. 1, 2015

(65) Prior Publication Data

US 2016/0001357 A1 Jan. 7, 2016

(30) Foreign Application Priority Data

Jul. 2, 2014 (JP) ..... 2014-136608

(51) Int. Cl.
*B22D 17/04* (2006.01)
*B22D 17/20* (2006.01)
*B22D 17/32* (2006.01)

(52) U.S. Cl.
CPC ..... *B22D 17/2015* (2013.01); *B22D 17/04* (2013.01); *B22D 17/32* (2013.01)

(58) Field of Classification Search
CPC .... B22D 17/04; B22D 17/20; B22D 17/2015; B22D 17/32
USPC ..... 164/303, 314, 342, 343
See application file for complete search history.

(56) References Cited

U.S. PATENT DOCUMENTS 4,836,267 A * 6/1989 Ueno et al. ..... B22D 17/24 164/113
7,371,061 B2 * 5/2008 Tsuji et al. ..... B29C 43/36 164/341
7,399,436 B2 * 7/2008 Tsuji et al. ..... B22D 17/266 164/137

FOREIGN PATENT DOCUMENTS

| | | |
|---|---|---|
| JP | 2007-098799 | 4/2007 |
| JP | 2010-264491 | 11/2010 |
| JP | 2012-091220 | 5/2012 |
| JP | 2012-232330 | 11/2012 |

OTHER PUBLICATIONS

English Language Abstract and Translation for JP 2010-264491 published Nov. 25, 2010.

(Continued)

*Primary Examiner* — Kevin P Kerns
(74) *Attorney, Agent, or Firm* — DLA Piper LLP US

(57) ABSTRACT

A die casting machine has a clamping device and an injection device. The clamping device has a fixed die plate which holds a fixed die, a movable die plate which holds a moving die, an electrically operated die opening and closing-use driving device which moves the movable die plate in a die opening and closing direction, and a clamping cylinder which generates a clamping force. The injection device has a sleeve, a plunger which capable of sliding in the sleeve, an electrically operated injection-use driving device which drives the plunger at least at the time of low speed injection, and an injection cylinder which drives the plunger at least at the time of high speed injection.

4 Claims, 7 Drawing Sheets

(56) References Cited

OTHER PUBLICATIONS

English Language Abstract and Translation for JP 2012-232330 published Nov. 29, 2012.
English Language Abstract and Translation for JP 2012-091220 published May 17, 2012.
English Language Abstract and Translation for JP 2007-098799 published Apr. 19, 2007.

* cited by examiner

FIG.5

| DEVICE \ PROCESS | | DIE-CLOSING | CLAMPING | LOW SPEED INJECTION | HIGH SPEED INJECTION | BOOSTING / HOLDING | INITIAL STEP OF DIE-OPENING | DIE-OPENING | CORE RETURN INJECTION RETURN | EJECTION |
|---|---|---|---|---|---|---|---|---|---|---|
| CLAMPING DEVICE | HYDRA-ULIC | P | P | OFF | OFF | OFF | OFF | OFF | P | P |
| | ELE-CTRIC | ON | OFF | OFF | OFF | OFF | ON | ON | OFF | OFF |
| INJECTION DEVICE | HYDRA-ULIC | OFF | OFF | OFF | ACC | ACC | P | OFF | OFF | OFF |
| | ELE-CTRIC | OFF | OFF | ON | ON | ON→OFF | OFF | OFF | ON | OFF |
| PUMP | | ON | ON | OFF | OFF | OFF | ON | ON | ON | ON |
| ACC | | — | — | — | RELEASE | RELEASE | — | FILL | — | — |

MOLDING APPARATUS

TECHNICAL FIELD

The present invention relates to a molding apparatus (molding machine). The molding apparatus is for example a die casting machine or injection molding machine.

BACKGROUND ART

A molding apparatus has a clamping device which holds, opens/closes, and clamps the molds and an injection device which injects and fills a molding material (for example metal in a molten state) into the clamped molds.

As the clamping device, for example, there is the one disclosed in Patent Literature 1. The clamping device in Patent Literature 1 is configured as a so-called two-platen clamping device which does not have a toggle mechanism. Further, the clamping device in Patent Literature 1 is configured as a so-called composite clamping device which opens/closes the molds by an electric motor and performs clamping by a hydraulic cylinder.

As the injection device, for example, there are those disclosed in Patent Literature 2 and Patent Literature 3. The injection devices in Patent Literature 2 and Patent Literature 3 are configured as so-called hybrid injection devices which perform low speed injection by electric motors and perform high speed injection by hydraulic cylinders.

Note that, there is also known a so-called full hydraulic type molding apparatus which performs all of the opening and closing of the molds, clamping, and injection by a hydraulic cylinder (for example Patent Literature 4). The full hydraulic type molding apparatus in Patent Literature 4 has a hydraulic power unit which is configured by partially combining a hydraulic device (for example tank, pump, valve etc.) supplying hydraulic oil to the hydraulic cylinder in the clamping device and hydraulic equipment supplying hydraulic oil to the hydraulic cylinder in the injection device.

CITATIONS LIST

Patent Literature

Patent Literature 1: Japanese Patent Publication No. 2007-98799A

Patent Literature 2: Japanese Patent Publication No. 2012-91220A

Patent Literature 3: Japanese Patent Publication No. 2012-232330A

Patent Literature 4: Japanese Patent Publication No. 2010-264491A

SUMMARY OF INVENTION

Technical Problem

The patent literatures described above proposes each of composite clamping devices and hybrid injection devices of mode capable of suitably utilizing hydraulic cylinders and electric motors. However, the above patent literatures do not mention suitable utilization of hydraulic cylinders and electric motors from the viewpoint of saving space or saving energy in the clamping devices and injection devices as a whole.

Accordingly, it is desired to provide a molding apparatus which is capable of suitably utilizing a liquid pressure cylinder (hydraulic cylinder) and an electric motor in a clamping device and injection device as a whole.

Solution to Problem

A molding apparatus according to one aspect of the present invention is provided with a clamping device which has a fixed die plate which holds a fixed die, a movable die plate which holds a moving die, an electrically operated die opening and closing-use driving device which moves the movable die plate in an opening and closing direction, and a clamping cylinder which generates a clamping force and with an injection device which has a plunger which is capable of sliding in a sleeve, an electrically operated injection-use driving device which drives the plunger at least at the time of low speed injection, and an injection cylinder which drives the plunger at least at the time of high speed injection.

Preferably, it is further provided with a liquid pressure unit which has a tank for storing a hydraulic fluid, a pump for sending out the hydraulic fluid from the tank, a plurality of valves for controlling the flow of the hydraulic fluid, and a holding base for holding the tank, the pump, and the plurality of valves and which supplies the hydraulic fluid to both of the clamping cylinder and the injection cylinder.

Preferably, the clamping device further has a core cylinder for making a core advance or retract to or from a space between the fixed die and the moving die, and in each molding cycle, the retraction of the core by the core cylinder and the retraction of the plunger by the injection-use driving device are simultaneously carried out.

Preferably, it further has an accumulator for supplying the hydraulic fluid to the injection cylinder, and in each molding cycle, the die-opening by the die opening and closing-use driving device and filling of the accumulator are simultaneously carried out.

Advantageous Effects of Invention

According to the above configurations, the clamping device and injection device as a whole can suitably utilize the hydraulic cylinder and electric motor.

BRIEF DESCRIPTION OF DRAWINGS

FIG. 5 is a diagram for explaining the operation of the die casting machine in FIG. 1.

DESCRIPTION OF EMBODIMENTS

First Embodiment

Figure 1:
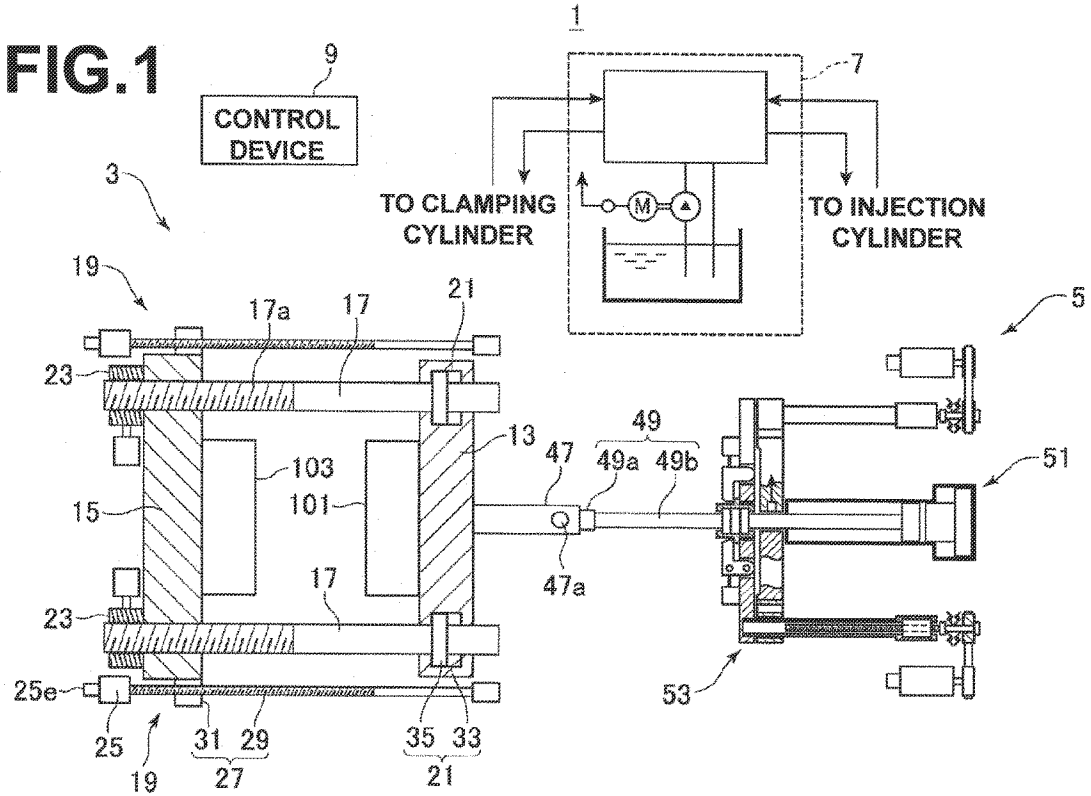
FIG. 1 is a plan view which partially includes a cross-sectional view and schematically shows a configuration of principal parts of a die casting machine according to a first embodiment of the present invention.

FIG. 1 is a plan view (partially including a cross-sectional view etc.) which schematically shows a configuration of principal parts of a die casting machine 1 according to a first embodiment of the present invention.

The die casting machine 1 for example has a clamping device 3 for opening and closing and clamping a fixed die 101 and a moving die 103, an injection device 5 which injects and fills a molten metal (metal material in a molten state) as the molding material (material) into a cavity 105 (see FIG. 2) which is configured by the fixed die 101 and the moving die 103 which are clamped by the clamping device 3, and a not shown ejection device which ejects a molded die cast article (molded article) from the fixed die 101 or moving die 103. Further, the die casting machine 1 has a liquid pressure unit 7 for supplying a hydraulic fluid (for example oil) to the devices in the die casting machine 1 such as the clamping device 3 and injection device 5 and a control device 9 for controlling the devices in the die casting machine 1.

(Configuration of Clamping Device)

Figure 2:
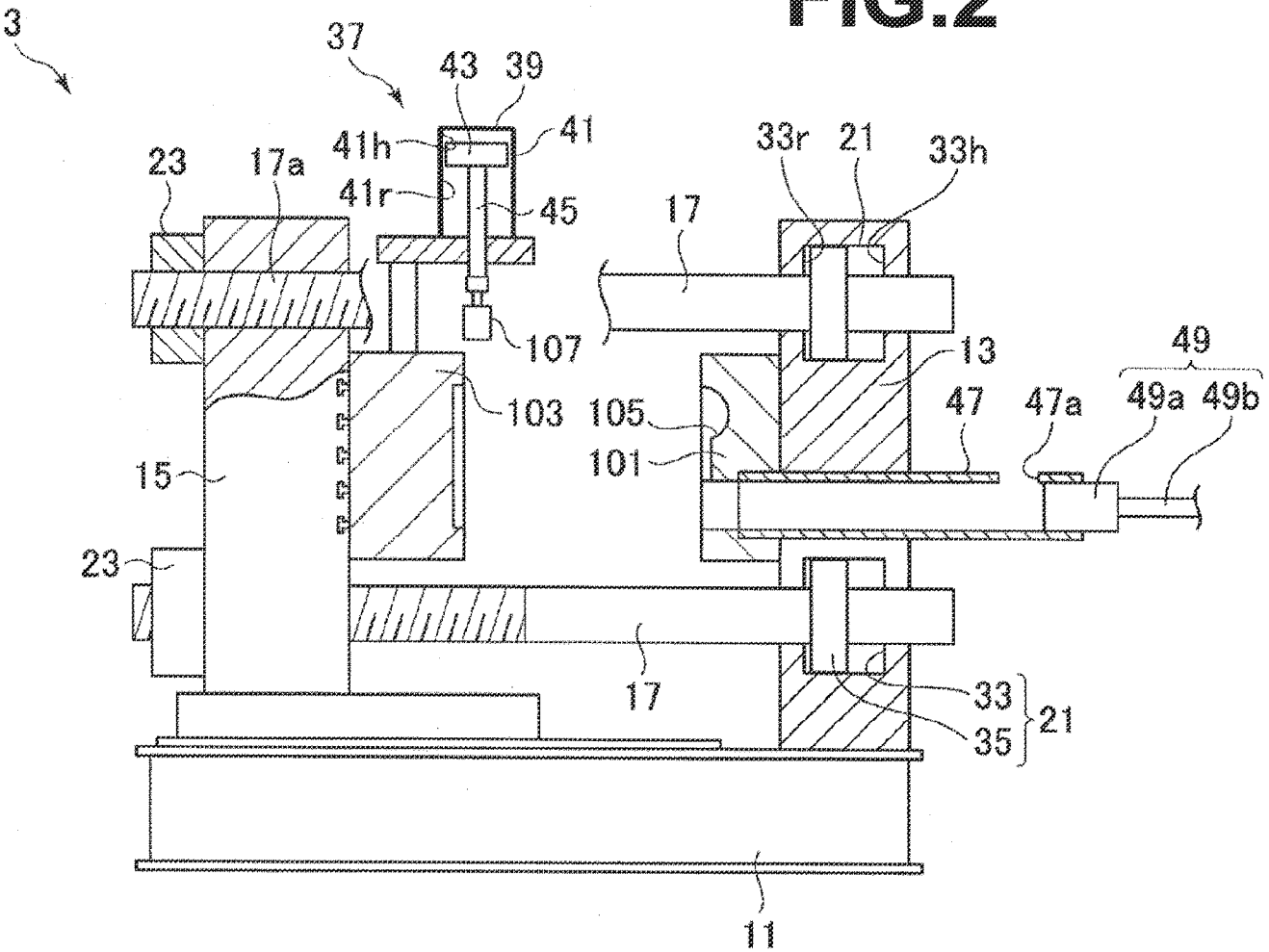
FIG. 2 is a side view which partially includes a cross-sectional view and schematically shows a configuration of principal parts of a clamping device of the die casting machine in FIG. 1.

FIG. 2 is a side view which partially includes a cross-sectional view and schematically shows a configuration of principal parts of the clamping device 3.

As shown in FIG. 1 and FIG. 2, the clamping device 3, for example, has a base 11 (FIG. 2), a fixed die plate 13 which is fixed onto the base 11 and holds the fixed die 101, a movable die plate 15 which is movable in the die opening and closing direction (right and left direction on the drawing sheet) above the base and holds the moving die 103, and a plurality of (four in the present embodiment) tie bars 17 which extend so as to penetrate through the fixed die plate 13 and movable die plate 15.

By the movable die plate 15 moving in the die opening and closing direction, the fixed die 101 and moving die 103 are closed or opened. Further, in a state where first end sides of the plurality of tie bars 17 are engaged with one of the fixed die plate 13 and the movable die plate 15 (movable die plate 15 in the present embodiment), the other end sides of the plurality of tie bars 17 are pulled with respect to the other of the fixed die plate 13 and the movable die plate 15 (fixed die plate 13 in the present embodiment), whereby the fixed die 101 and the moving die 103 are clamped.

The clamping device 3 is for example configured by a so-called composite type clamping device which opens and closes the dies by an electric driving operation and performs the clamping by a liquid pressure (oil pressure) driving operation. Specifically, for example, this is as follows.

The clamping device 3 for example has die opening/closing-use driving devices 19 (FIG. 1) for driving the movable die plate 15 mainly for opening and closing the dies. Further, the clamping device 3, mainly for clamping the dies, for example has a plurality of clamping cylinders 21 for driving the plurality of tie bars 17 and has a plurality of engagement devices 23 which are engaged with the plurality of tie bars 17.

The die opening/closing-use driving devices 19 are for example provided as a pair of devices on the two sides of the right-left direction of the movable die plate 15. Each die opening/closing-use driving device 19 for example has a rotary die opening/closing-use electric motor 25 and a die opening/closing-use screw mechanism 27 for converting the rotation of the die opening/closing-use electric motor 25 to a translational motion.

Each die opening/closing-use electric motor 25 may be a DC motor or AC motor or may be an induction motor or synchronous motor. The die opening/closing-use electric motor 25 is for example configured as a servo motor and configures a servo mechanism together with an encoder **25*e* for detecting the rotation of the die opening/closing-use electric motor 25 and a not shown servo driver which supplies electric power to the die opening/closing-use electric motor 25**.

Note that, in the explanation of the operation which will be given later, when the die opening/closing-use electric motor 25 is stopped, the die opening/closing-use electric motor 25 may be rendered a torque free state or may be controlled so as to stop at a constant position (in the case of a servo motor), or may be configured so as to include a brake and the brake may be used. A suitable stopping method may be selected in accordance with a situation for stopping the die opening/closing-use electric motor 25 and so on.

Each die opening/closing-use screw mechanism (conversion mechanism, die opening/closing-use conversion mechanism) 27 for example has a die opening/closing-use screw shaft 29 which extends in the die opening and closing direction and a die opening/closing-use nut 31 which is screwed with the die opening/closing-use screw shaft 29. The die opening/closing-use screw shaft 29 is for example supported by a not shown support member or the like which is provided on the base 11 or fixed die plate 13 so that it cannot move in the axial direction and can rotate around the axis. The die opening/closing-use nut 31 is for example fixed to the movable die plate 15 so that it cannot rotate around the axis.

When the rotation of the die opening/closing-use electric motor 25 is transmitted to the die opening/closing-use screw shaft 29 and the die opening/closing-use screw shaft 29 is rotated around the axis, the die opening/closing-use nut 31 moves in the die opening and closing direction. Due to this, the movable die plate 15 moves in the die opening and closing direction. Note that, the rotation of the die opening/closing-use electric motor 25 may be directly transmitted to the die opening/closing-use screw shaft 29 by connection of the die opening/closing-use screw shaft 29 and the output shaft of the die opening/closing-use electric motor 25 through a coupling or integral formation of the die opening/closing-use screw shaft 29 and the output shaft of the die opening/closing-use electric motor 25 (illustrated example) or may be indirectly transmitted to the die opening/closing-use screw shaft 29 through a pulley/belt mechanism or gear mechanism or another transmission mechanism.

Each clamping cylinder 21 for example has a clamping cylinder portion 33 which is provided at the fixed die plate 13 and a clamping piston 35 which is fixed to one end of the tie bar 17 and is accommodated in the clamping cylinder portion 33. The clamping piston 35 divides the interior of the clamping cylinder portion 33 into a clamping rod side chamber **33*r* on the front face side (movable die plate 15 side) of the fixed die plate 13 and a clamping head side chamber 33*h* on the opposite side to the former. By selectively supplying the hydraulic fluid (for example oil) to these two cylinder chambers, the clamping piston 35** moves in the die opening and closing direction.

Each engagement device 23 is for example configured including a half nut or another split nut and is supported upon the movable die plate 15 so that it cannot move in the die opening and closing direction with respect to the movable die plate 15. On the other hand, in the end part of a tie bar 17 on the movable die plate 15 side, an engaged portion 17*a* which can engage (can mesh) with the engagement device 23 in the die opening and closing direction is formed.

In a state where the moving die 103 contacts the fixed die 101 and the engagement devices 23 mesh with the engaged portions 17*a*, the tie bars 17 are extended by supply of the hydraulic fluid to the clamping cylinders 21 so that the clamping pistons 35 move to the back face side of the fixed die plate 13. Due to this, the fixed die 101 and moving die 103 are clamped.

Note that, the grooves or projected rims of the engagement devices 23 and engaged portions 17*a* may be spiral shaped or may be arranged perpendicular to the axial direction of the tie bars 17 in an array in the axial direction. The driving source of the engagement devices 23 is for example a linear motor, hydraulic cylinder, or pneumatic cylinder.

As shown in FIG. 2, the clamping device 3 has a core pullout device 37 for making the core 107 advance/retract with respect to the space between the fixed die 101 and the moving die 103.

The core pullout device 37 for example has a core cylinder 39 which is supported upon the fixed die 101 or moving die 103 (moving die 103 in the present embodiment).

The core cylinder 39 has a core cylinder member 41, a core piston 43 which can slide inside the core cylinder member 41, and a core piston rod 45 which is fixed to the core piston 43 and extends outward from the core cylinder member 41.

The core cylinder 39 is arranged so that the direction inclined (for example perpendicular) to the die opening and closing direction is the axial direction. The core cylinder member 41 is for example fixed to the moving die 103. The core piston rod 45 is connected to the core 107. The core piston 43 divides the interior of the core cylinder member 41 into a core rod side chamber 41*r* on the core piston rod 45 side and a core head side chamber 41*h* on the opposite side to the former. By selectively supplying the hydraulic fluid to these two cylinder chambers, the core 107 enters into or retracts from the space between the fixed die 101 and the moving die 103.

(Configuration of Injection Device)

Figure 3:
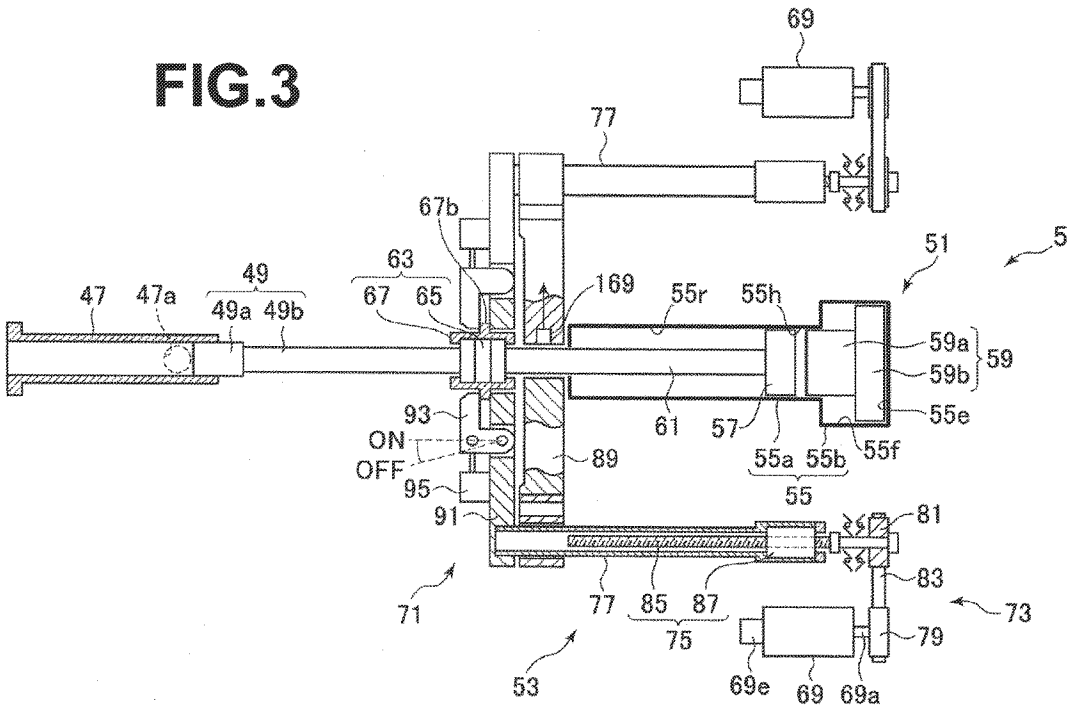
FIG. 3 is a plan view which partially includes a cross-sectional view and schematically shows a configuration of principal parts of an injection device of the die casting machine in FIG. 1.

FIG. 3 is a cross-sectional view seen from the upper part and schematically shows a configuration of principal parts of the injection device 5.

The injection device 5 has a sleeve 47 which is communicated with the cavity 105, a plunger 49 which ejects the molten metal in the sleeve 47 into the cavity 105, an injection cylinder 51 for driving the plunger 49, and an electrically operated injection-use driving device 53 which drives the plunger 49.

The configurations of the sleeve 47 and plunger 49 may be the same as the known configurations. The sleeve 47, for example, as shown in FIG. 1 and FIG. 2, is provided so as to be inserted into the fixed die plate 13 and fixed die 101. The plunger 49 has a plunger tip 49*a* for sliding through the sleeve 47 and has a plunger rod 49*b* which is fixed to the plunger tip 49*a*.

By sliding motion of the plunger 49 in the sleeve 47 toward the cavity 105 (movement forward) in a state where the molten metal is supplied to the sleeve 47 from a hot metal supply port 47*a* which is formed in the sleeve 47, the molten metal is injected and filled into the cavity 105.

Returning to FIG. 3, the injection cylinder 51 is for example configured by a direct coupled booster cylinder. That is, the injection cylinder 51 has an injection cylinder member 55, an injection piston 57 and booster piston 59 which are capable of sliding inside the injection cylinder member 55, and an injection piston rod 61 which is fixed to the injection piston 57 and is exposed from the injection cylinder member 55.

The injection cylinder member 55 has an injection cylinder portion 55*a* and a booster cylinder portion 55*b* which is located on the back of the former and has a larger diameter than that of the injection cylinder portion 55*a*. The injection piston 57 can slide through the injection cylinder portion 55*a* and divides the interior of the injection cylinder portion 55*a* into an injection rod side chamber 55*r* on the front side and an injection head side chamber 55*h* on the opposite side to the former. The booster piston 59 has a small diameter portion 59*a* capable of sliding through the injection cylinder portion 55*a* and a large diameter portion 59*b* capable of sliding through the booster cylinder portion 55*b*. The large diameter portion 59*b* divides the interior of the booster cylinder portion 55*b* into a front side chamber 55*f* on the front side and a rear side chamber 55*e* on the rear side.

When the hydraulic fluid is supplied to the injection head side chamber 55*h*, the injection piston 57 moves forward. Further, when the hydraulic fluid is supplied to the rear side chamber 55*e* in a state where the outflow of the hydraulic fluid from the injection head side chamber 55*h* is prohibited and the front side chamber 55*f* is rendered a tank pressure, the hydraulic fluid of the injection head side chamber 55*h* is boosted in accordance with a difference of pressurized areas in the front and back of the booster piston 59.

The injection cylinder 51 is arranged coaxially (in series) on the back with respect to the plunger 49. The tip end of the injection piston rod 61 is directly connected to the rear end of the plunger 49. Accordingly, the plunger 49 advances and retracts as well along with the advance and retraction of the injection piston rod 61.

The plunger 49 and the injection piston rod 61 are connected by a coupling 63. The coupling 63 has for example a spacer 65 which is interposed between the rear end of the plunger 49 and the front end of the injection piston rod 61 and has a cover 67 which covers these. The cover 67 has an abutted portion 67*b* which is provided for connection with the injection-use driving device 53. The abutted portion 67*b* is for example configured by a flange which is formed on the outer circumferential surface of the cover 67.

The injection-use driving device 53 has injection-use electric motors 69 and detachable portions 71 which are driven in the front-back direction by the drive force of the injection-use electric motors 69 and are detachable with respect to the plunger 49 (injection piston rod 61). Between the injection-use electric motors 69 and the detachable portions 71, for example, transmission mechanisms 73, injection-use screw mechanisms 75, and guide shafts 77 are interposed in that order from the injection-use electric motors 69 to the detachable portions 71. The injection-use driving device 53 has for example two sets of these injection-use electric motors 69, transmission mechanisms 73, injection-use screw mechanisms 75, guide shafts 77, and detachable portions 71 right-left symmetrically.

Each injection-use electric motor 69 is a rotary electric motor and is for example arranged so that its output shaft 69*a* is parallel to the injection piston rod 61 and faces backward. The injection-use electric motor 69 may be a DC motor or AC motor or may be an induction motor or synchronous motor. The injection-use electric motor 69 is preferably an electric motor with a brake. The injection-use electric motor 69 is for example configured as a servo motor and configures a servo mechanism together with an encoder 69*e* which detects the rotation of the injection-use electric motor 69 and a not shown servo driver for supplying electric power to the injection-use electric motor 69. Note that, in the explanation of the operation which will be given later, when the injection-use electric motor 69 is to be stopped, the suitable stopping method may be selected in accordance with the situation in the same way as the die opening/closing-use electric motor 25.

Each transmission mechanism 73 is for example configured by a pulley-belt mechanism and has a first pulley 79 which fixed to the output shaft 69*a* of the injection-use electric motor 69, a second pulley 81 which is fixed to the injection-use screw mechanism 75, and a belt 83 which is suspended between the first pulley 79 and the second pulley 81. Accordingly, when the injection-use electric motor 69 is rotated, that rotation is transmitted through the transmission mechanism 73 to the injection-use screw mechanism 75.

Each injection-use screw mechanism 75 (conversion mechanism and injection-use conversion mechanism) is for example configured by a ball screw mechanism and has an injection-use screw shaft 85 and an injection-use nut 87 which is screwed with the injection-use screw shaft 85 through a not shown ball.

Each injection-use screw shaft 85 is arranged parallel to the injection piston rod 61, is fixed concentrically or coaxially with the second pulley 81, and is restricted in movement in the axial direction and is allowed to rotate around the axis by an appropriate bearing. On the other hand, the injection-use nut 87 is allowed to move in the axial direction and is restricted in rotation around the axis.

Accordingly, when the injection-use electric motor 69 is rotated, that rotation is transmitted through the transmission mechanism 73 to the injection-use screw shaft 85. Then, by rotation of the injection-use screw shaft 85, the injection-use nut 87 moves in the direction parallel to the injection piston rod 61.

Each guide shaft 77 extends in a direction parallel to the injection piston rod 61, is fixed at one end to the injection-use nut 87, and is fixed at the other end to the detachable portion 71. Accordingly, when the injection-use nut 87 moves in the front-back direction, the guide shaft 77 and detachable portion 71 move in the front-back direction as well.

The guide shaft 77 is for example formed in a hollow state that accommodates the injection-use screw shaft 85. The guide shaft 77, for example, has a length long enough to cover the entire portion in the injection-use screw shaft 85 which is ahead of the injection-use nut 87 even when the injection-use nut 87 is located at the backward limit of the injection cycle with respect to the injection-use screw shaft 85 (over the injection cycle from another viewpoint). Preferably, the front end of the guide shaft 77 is closed.

The guide shaft 77 is for example slidably inserted into a bushing provided in an injection frame 89 which is fixed to the fixed die plate 13. Due to this, the load etc. of the guide shaft 77 is supported by the injection frame 89, and application of unnecessary force to the plunger 49 etc. is suppressed.

Each detachable portion 71 has a base 91, a hook 93 slidably supported upon the base 91, and an actuator 95 for driving the hook 93. The detachable portions 71 share the base 91.

The base 91 is fixed to the guide shafts 77. Accordingly, the base 91 is driven in the front-back direction together with the injection-use nuts 87 and guide shafts 77 by the drive force of the injection-use electric motors 69. Further, by the movement in front-back direction of the base 91, the hooks 93 and actuators 95 which are supported upon the base 91 move in the front-back direction as well. Note that, fixation of the base 91 and two guide shafts 77 contributes to the restriction of rotation of each guide shaft 77 around the axis and consequently contributes to the restriction of rotation of the injection-use nut 87.

The base 91 has for example a plate-shaped portion having a hole part formed therein into which the injection piston rod 61 is inserted and can abut against the abutted portion 67*b* of the coupling 63 from the back side. That is, the base 91 is, by abutment against the abutted portion 67*b*, restricted in relative forward movement with respect to the plunger 49 (injection piston rod 61) and is allowed to relatively retract with respect to the plunger 49 backward from that abutment position.

Accordingly, by moving the base 91 forward in a state where the base 91 abut against the abutted portions 67*b*, the plunger 49 can be moved forward. That is, the plunger 49 can be moved forward by the drive forces of the injection-use electric motors 69. Further, by supplying the hydraulic fluid to the injection head side chamber 55*h* to move the injection piston rod 61 at a relatively high speed and so on, it is possible to make the plunger 49 relatively move forward with respect to the base 91.

Each hook 93 is for example formed in a roughly L-shape and is rotatably supported at one end by the corresponding base 91. Further, the hook 93 can move between the position at which it can engage with the abutted portion 67*b* in the retraction direction of the plunger 49 ("ON" position) and the position at which the engagement is released ("OFF" position). Note that, the hook 93 can grip the abutted portion 67*b* together with the base 91 at the "ON" position.

By setting the hooks 93 OFF (releasing engagement), it is possible to make the plunger 49 relatively move forward with respect to the base 91. Further, by setting the hooks 93 ON (engagement), the plunger 49 can be retracted along with the retraction of the base 91. That is, the plunger 49 can be retracted by the drive forces of the injection-use electric motors 69.

The injection-use driving device 53 is configured and arranged so that it can make the hooks 93 engage with the abutted portions 67*b* over a stroke of the injection piston 57. For example, the strokes of the injection-use screw mechanisms 75 are made equivalent to the stroke of the injection cylinder 51, and the injection-use driving device 53 is arranged so that the injection-use nuts 87 are positioned at the backward limit as well when the injection piston 57 is positioned at the backward limit.

Each actuator 95 is for example configured by an actuator performing reciprocating action (expansion/contraction from another viewpoint). The actuator 95 is for example a linear motor, air pressure cylinder, or liquid pressure cylinder. By the reciprocating action of the actuator 95, the corresponding hook 93 is rendered ON or OFF.

(Configuration of Liquid Pressure Unit 7)

Figure 4:
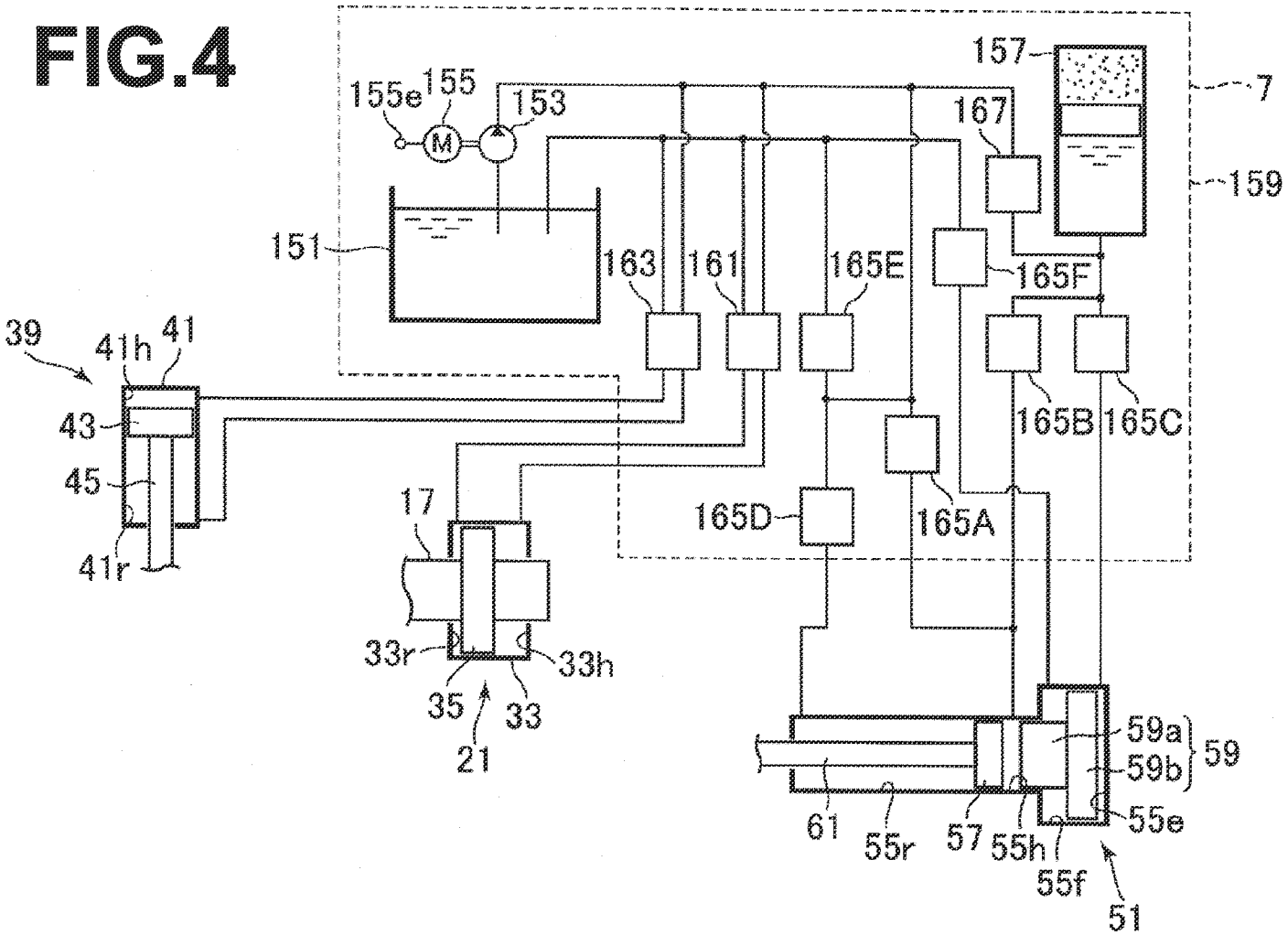
FIG. 4 is a diagram which schematically shows a configuration of a hydraulic system of the die casting machine in FIG. 1.

FIG. 4 is a diagram which schematically shows the configuration of a hydraulic system of the die casting machine 1.

The liquid pressure unit 7 for example has a tank 151 which stores the hydraulic fluid, a pump 153 which sends out the hydraulic fluid in the tank 151, a pump-use electric motor 155 for driving the pump 153, an accumulator 157 which supplies the accumulated hydraulic fluid, parts of passages which connect these elements and the hydraulic cylinders explained above (21, 39, 51) to each other, a plurality of valves (161, 163, 165A to 165F, and 167) which control the flow of the hydraulic fluid, and a holding base 159 for holding the parts of the liquid pressure unit 7.

The tank 151 is for example an open tank and holds the hydraulic fluid under atmospheric pressure. The tank 151 for example eliminates excess and deficiency of the hydraulic fluid in each hydraulic cylinder. Further, it supplies the hydraulic fluid through the pump 153 to the accumulator 157.

The pump 153 may be a gear pump, vane pump, or other rotary pump which discharges the hydraulic fluid by the rotation of a rotor or may be an axial type plunger pump, radial type plunger pump, or other plunger pump which discharges the hydraulic fluid by reciprocating action of a piston. The pump 153 may be configured by a constant capacity pump which is fixed in discharge amount in motion of the rotor or piston over one period or may be configured by a variable capacity pump which can change that discharge amount. Further, the pump 153 need only be able to discharge the hydraulic fluid in one direction, but may have the same structure as a bi-directional (2-direction) pump.

The pump-use electric motor 155 is a rotary electric motor. The pump-use electric motor 155 may be a DC motor or AC motor or may be an induction motor or synchronous motor. The pump-use electric motor 155 may function as a constant speed electric motor provided in an open loop or may function as a servo motor provided in a closed loop. In the present embodiment, the pump-use electric motor 155 is configured as a servo motor and configures a servo mechanism together with the encoder 155*e* detecting the rotation of the pump-use electric motor 155 and a not shown servo driver supplying electric power to the pump-use electric motor 155. In the explanation of operation which will be given later, when the pump-use electric motor 155 is stopped, a suitable stopping method may be selected in accordance with the situation due to which the pump-use electric motor 155 is stopped in the same way as other electric motors.

The accumulator 157 may be configured by a gravimetric, spring type, gas pressure type (including pneumatic type), cylinder type, bladder type, or another accumulator having a suitable form. For example, the accumulator 157 is a gas pressure type, cylinder type, or bladder type accumulator, and the pressure is accumulated by compression of the gas (for example air or nitrogen) which is held in the accumulator 157. The accumulated hydraulic fluid is supplied to the injection cylinder 51.

The plurality of valves include for example a clamping valve 161 for controlling the flow of the hydraulic fluid relating to the clamping cylinders 21, a core-use valve 163 for controlling the flow of the hydraulic fluid relating to the core cylinder 39, a first injection-use valve 165A to sixth injection-use valve 165F for controlling the flow of the hydraulic fluid relating to the injection cylinder 51, and a filling valve 167 for controlling the flow of the hydraulic fluid relating to filling of the accumulator 157.

The clamping valve 161 is for example configured by a 4-port 3-position switching valve. At one position, the clamping rod side chamber 33*r* and the pump 153 are connected and the clamping head side chamber 33*h* and the tank 151 are connected. At another position, the clamping head side chamber 33*h* and the pump 153 are connected and the clamping rod side chamber 33*r* and the tank 151 are connected. At the remaining positions, all of the connections described above are closed.

The core-use valve 163 is for example configured by a 4-port 3-position switching valve. At one position, the core rod side chamber 41*r* and the pump 153 are connected and the core head side chamber 41*h* and the tank 151 are connected. At another one position, the core head side chamber 41*h* and the pump 153 are connected and the core rod side chamber 41*r* and the tank 151 are connected. At the remaining positions, all of the connections described above are closed.

The first injection-use valve 165A is for example configured by a pilot type check valve which permits or prohibits the flow of the hydraulic fluid relating to the injection head side chamber 55*h*. The first injection-use valve 165A is used to control the flow with the injection head side chamber 55*h* for example for the injection rod side chamber 55*r*, pump 153, and/or tank 151.

The second injection-use valve 165B is for example configured by a pilot type check valve which permits or prohibits the flow of the hydraulic fluid between the injection head side chamber 55*h* and the accumulator 157.

The third injection-use valve 165C is for example configured by a pilot type check valve which permits or prohibits the flow between the rear side chamber 55*e* and the accumulator 157.

The fourth injection-use valve 165D is for example configured by a servo valve which permits or prohibits the flow of the hydraulic fluid relating to the injection rod side chamber 55*r*. The fourth injection-use valve 165D is used to control the flow with the injection rod side chamber 55*r* for example for the injection head side chamber 55*h*, tank 151, and/or pump 153. Note that, the fourth injection-use valve 165D configures a meter-out circuit.

The fifth injection-use valve 165E is for example configured by a pilot type check valve which permits or prohibits the flow of the hydraulic fluid according to the tank 151. The fifth injection-use valve 165E is used to control the flow with the tank 151 for example for the injection rod side chamber 55*r* and/or injection head side chamber 55*h*.

The sixth injection-use valve 165F is for example configured by a pilot type check valve which permits or prohibits the flow between the tank 151 and the front side chamber 55*f*.

The filling valve 167 is for example configured by a pilot type check valve which permits or prohibits the flow between the pump 153 and the accumulator 157.

The holding base 159 is a housing-shaped member or framework-shaped member which is configured by a metal or the like. The holding base 159 may be integrally formed or may be configured by a combination of a plurality of members. To the holding base 159, for example, the tank 151, pump 153, pump-use electric motor 155, accumulator 157, and plurality of valves (161, 163, 165A to 165F, and 167) are fixed together. These elements may be accommodated in the housing-shaped holding base 159 or may be fixed to the framework-shaped holding base 159 and be exposed to the outside. The holding base 159 is provided at a suitable position, for example, the lateral side of the clamping device 3 or injection device 5.

The control device 9 (FIG. 1) includes, for example, although not particularly shown, a CPU, ROM, RAM, external memory device, input circuit, and output circuit. The control device 9 outputs control signals for controlling the portions based on various types of input signals which are input.

What input signals to the control device 9 are for example a not shown input device accepting the input operation by the user, encoders (25*e*, 69*e*, 155*e*) of various types of motors, a position sensor 169 (FIG. 3) for detecting the position of the plunger 49, and a not shown pressure sensor which detects the pressure of the hydraulic fluid at a suitable position in the hydraulic system.

What the control device 9 outputs signals to are for example a not shown display unit which displays information to the user, servo drivers of various types of motors, various types of valves, and an actuator 95 (or driver of that).

The position sensor 169 for example configures a linear encoder together with a not shown scale portion. For example, the position sensor 169 is provided in front of the injection cylinder member 55 in a fixed manner, and the scale portion is provided on the injection piston rod 61 and extends in its axial direction. The position sensor 169 indirectly detects the position of the plunger 49 by detecting the position of the scale portion which moves along with the movement of the injection piston rod 61. Note that, by differentiating the detected position, the position sensor 169 or control device 9 can detect the speed.

The pressure sensor is provided at a suitable position in the hydraulic system. For example, although particularly not shown, a pressure sensor which detects the pressure of the clamping rod side chamber 33*r* is provided. The control device 9 can identify the clamping force based on the detection value of this pressure sensor. Note that, the clamping force may be identified from displacement of the clamping piston 35 or the amount of expansion of the tie bars 17. Further, for example, a pressure sensor detecting the pressures of the injection head side chamber 55*h* and injection rod side chamber 55*r* is provided. The control device 9 can identify the pressure which is applied to the molten metal by the plunger 49 based on these detection values of the pressure sensor. Further, for example, though not particularly shown, a pressure sensor detecting the pressure of the accumulator 157 is provided. The control device 9 can judge completion of filling of the accumulator 157 based on that detection value.

(Operation of Die Casting Machine 1)

FIG. 5 is a table for explaining the operation of the die casting machine 1.

In this table, the row of "LIQUID PRESSURE" of "CLAMPING DEVICE" shows the driving state of the hydraulic system (clamping cylinders 21 and core cylinder 39) of the clamping device 3. The row of "ELECTRICALLY OPERATED" of "CLAMPING DEVICE" shows the driving state of the die opening/closing-use electric motor 25. The row of "LIQUID PRESSURE" of "INJECTION DEVICE" shows the driving state of the injection cylinder 51. The row of "ELECTRICALLY OPERATED" of "INJECTION DEVICE" shows the driving state of the injection-use electric motor 69. The row of "PUMP" shows the driving state of the pump 153 (pump-use electric motor 155). The row of "ACC" shows the state of the accumulator 157.

Further, each column corresponds to the process executed by the die casting machine 1. They are shown from left to right in time sequence.

In the rows of "ELECTRICALLY OPERATED" of "CLAMPING DEVICE" and "ELECTRICALLY OPERATED" of "INJECTION DEVICE" and "PUMP", "ON" shows the state where electric power is supplied to the electric motor and the motor is driven (rotated), while "OFF" shows the state where it is stopped. In "LIQUID PRESSURE" of each "CLAMPING APPARATUS" and "INJECTION DEVICE", "P" shows the state where the hydraulic fluid is supplied from the pump 153, "ACC" shows the state where the hydraulic fluid is supplied from the accumulator 157, and "OFF" shows the state which is not any of the states described above.

Before the die closing process shown as the first process in this table, the movable die plate 15 is positioned at a predetermined die opening position (for example, a die open limit). The clamping piston 35 is for example positioned at the driving limit on the clamping rod side chamber 33*r* side. The core piston 43 is for example positioned at the backward limit. The plunger 49 (injection piston rod 61) and booster piston 59 are for example positioned at the backward limit. Various types of valves are for example controlled so as to prohibit the flow of the hydraulic fluid. Further, the various types of electric motors (25, 69, 155) are for example stopped.

(Die Closing Process)

In the die closing process, the control device 9 drives the die opening/closing-use electric motor 25 and moves the movable die plate 15 to the die closing direction. Then, the control device 9 for example stops the die opening/closing-use electric motor 25 when the detection value of the encoder 25*e* reaches a value which is set in advance corresponding to the die contact position or the position in the vicinity of that. Note that, a not shown position sensor which detects the position of the movable die plate 15 may be provided and the control may be carried out based on the detection value of that position sensor.

The control device 9 drives the pump-use electric motor 155 and sends out the hydraulic fluid from the pump 153 parallel to the movement of the movable die plate 15 described above. Further, the control device 9 switches the core-use valve 163 to supply the hydraulic fluid from the pump 153 to the core head side chamber 41*h* and permit the discharge of the hydraulic fluid from the core rod side chamber 41*r* to the tank 151. Due to this, the core 107 is inserted between the fixed die 101 and the moving die 103. After insertion, the control device 9 switches the core-use valve 163 to prohibit the flow of the hydraulic fluid relating to the core cylinder 39.

After the completion of die closing as in the above-described way, though not particularly shown, the control device 9 closes the engagement devices 23 and engages the movable die plate 15 and the tie bars 17. Note that, meshing between the engagement devices 23 and the engaged portions 17*a* at this time may be adjusted by the stopping position of the movable die plate 15 described above being set at a position which enables meshing or may be carried out by movement of the tie bars 17 by the clamping cylinders 21 after the stopping of the movable die plate 15.

(Clamping Process)

After closing the engagement devices 23, the control device 9 drives the pump-use electric motor 155 and sends out the hydraulic fluid from the pump 153. Further, the control device 9 switches the position of the clamping-use valve 161 to supply the hydraulic fluid from the pump 153 to the clamping rod side chamber 33*r* and permit the flow of the hydraulic fluid from the clamping head side chamber 33*h* to the tank 151. Due to this, the clamping piston 35 moves to the back of the fixed die plate 13, the tie bars 17 are extended, and thus the clamping is carried out.

When the desired clamping force is obtained, the control device 9 switches the position of the clamping-use valve 161 to prohibit the flow of the hydraulic fluid relating to the clamping cylinders 21 and stops the pump-use electric motor 155. That is, the control device 9 maintains the intended clamping force. Note that, considering leakage of the hydraulic fluid, until the later explained pressure holding operation is completed, the supply of the hydraulic fluid from the pump-use electric motor 155 to the clamping cylinders 21 may be continued at a suitable timing and/or supply rate.

(Low Speed Injection Process)

Low speed injection is the process of moving the plunger forward at a relatively low speed (so-called critical speed) to inject the molten metal into the cavity 105 in order to reduce entrainment of air into the molten metal. That injection speed is suitably set in accordance with the diameter of the sleeve 47 or amount of hot metal in one shot or the like. However, for example, it is less than 1 m/s, more specifically it is for example 0.2 m/s to 0.5 m/s.

When the clamping is completed and the molten metal is supplied to the sleeve 47 by a not shown hot metal supply device, the control device 9 drives the injection-use electric motor 69 and moves the detachable portion 71 forward. The detachable portion 71 (base 91) is restricted in relative forward movement with respect to the plunger 49, therefore the plunger 49 moves forward as well. Due to this, the low speed injection is carried out.

By the forward movement of the detachable portion 71, the injection piston 57 moves forward as well. The control device 9 suitably controls the liquid pressure unit 7 so that the discharge of the hydraulic fluid from the injection rod side chamber 55*r* and the supply of the hydraulic fluid to the injection head side chamber 55*h* are suitably carried out along with the forward movement of the injection piston 57.

For example, the first injection-use valve 165A and fourth injection-use valve 165D permit the flow of the hydraulic fluid from the injection rod side chamber 55*r* to the injection head side chamber 55*h*. Due to this, the hydraulic fluid discharged from the injection rod side chamber 55*r* is refluxed to the injection head side chamber 55*h*. Note that, a passage connecting the injection rod side chamber 55*r* and the injection head side chamber 55*h* configures a run-around circuit.

The pressurized area of the injection head side chamber 55*h* is larger than the pressurized area of the injection rod side chamber 55*r* by a difference equivalent to the cross-sectional area of the injection piston rod 61. Therefore, even when the hydraulic fluid of the injection rod side chamber 55*r* is refluxed to the injection head side chamber 55*h*, shortage of the hydraulic fluid occurs. The shortage of the hydraulic fluid is for example made up for by supply of the hydraulic fluid from the tank 151 to the injection head side chamber 55*h*. Specifically, for example, the fifth injection-use valve 165E prohibits the flow from the injection cylinder 51 to the tank 151 and permits the flow in an inverse direction to that.

Note that, the shortage of the hydraulic fluid may be made up for by the supply of the hydraulic fluid from the pump 153 in place of the supply of the hydraulic fluid from the tank 151. The amount of supply of the hydraulic fluid at this time may be of an extent where formation of negative pressure in the injection head side chamber 55*h* is resolved or may be magnitude such several fractions of the drive force for driving the plunger 49 are borne by the injection cylinder 51 (the injection cylinder 51 assists the injection-use electric motor 69).

The speed of the plunger 49 is controlled by the adjustment of the rotation speed of the injection-use electric motor 69. Specifically, the control device 9 controls the rotation speed of the injection-use electric motor 69 by feedback based on the speed of the plunger 49 which is detected by the position sensor 169. An electric motor has a higher controllability than a hydraulic cylinder, therefore the speed of the low speed injection can be controlled with a high accuracy.

In low speed injection, the detachable portion 71 may be set ON or OFF. Note, when it is set ON, for example, when multistage control including deceleration is carried out, the plunger 49 advancing so as to separate from the base 91 due to inertial force can be prevented.

(High Speed Injection Process)

High speed injection is the process of moving the plunger forward at a relatively high speed and injecting the molten metal into the cavity 105 for the purpose of filling the molten metal in the cavity without delay in solidification of the molten metal. The injection speed is suitably set in accordance with the diameter of the sleeve 47 or amount of hot metal of one shot. However, for example, it is 1 m/s or more, more specifically, it is for example 2 m/s to 10 m/s.

The control device 9 opens the second injection-use valve 165B and supplies the hydraulic fluid from the accumulator 157 to the injection head side chamber 55*h* when the position of the plunger 49 according to the detection value of the position sensor 169 reaches the predetermined high speed switching position. Further, the control device 9 adjusts the servo valve constituting the fourth injection-use valve 165D to a suitable degree of opening. Further, the control device 9 sets the detachable portion 71 OFF (releases engagement) continuously from the low speed injection or sets OFF the detachable portion 71 which was ON in the low speed injection.

Due to this, the injection piston 57, injection piston rod 61, and plunger 49 move forward at a relatively high speed. At this time, the engagement of the detachable portion 71 is released, therefore the plunger 49 etc. move forward while leaving behind the detachable portion 71, guide shaft 77, and injection-use nut 87 which move at a relatively low speed. Accordingly, the injection-use driving device 53 does not become a load preventing the forward movement of the plunger 49 etc. Then, the molten metal in the sleeve 47 is injected into the cavity 105 at a high speed.

The speed of the plunger 49 is controlled by adjustment of the degree of opening of the fourth injection-use valve 165D which is the servo valve. Note that, the control device 9 may control by feedback the degree of opening of the fourth injection-use valve 165D as well based on the speed of the plunger 49 which is detected by the position sensor 169.

After that, though not particularly shown, decelerated injection is carried out. That is, when the molten metal is filled in the cavity 105 to a certain extent, the plunger 49 receives a counterforce from that filled molten metal and is decelerated while the injection pressure suddenly rises. Note that, the operations of the portions are the same as those at the time of high speed injection. Note, in order to mitigate the shock at the time of filling, suitable deceleration control may be carried out as well. For example, the degree of opening of the fourth injection-use valve 165D as the servo valve may be made small when predetermined deceleration start conditions such as arrival of the plunger 49 at a predetermined deceleration position are satisfied.

(Boosting/Holding Process)

When the predetermined boosting start conditions are satisfied, the control device 9 controls the liquid pressure unit 7 so as to start the boosting process. The boosting start conditions are for example that the injection pressure based on the detection value of a not shown pressure sensor which detects the pressure of the injection head side chamber 55*h* (and, according to need, a not shown pressure sensor which detects the pressure of the injection rod side chamber 55*r*)

reaches a predetermined value or that the detection position of the plunger 49 detected by the position sensor 169 reaches a predetermined position.

In the boosting process, for example, the fourth injection-use valve 165D and fifth injection-use valve 165E permit the discharge of the hydraulic fluid from the injection rod side chamber 55*r* to the tank 151. The first injection-use valve 165A and second injection-use valve 165B prohibit the outflow of the hydraulic fluid from the injection head side chamber 55*h*. The sixth injection-use valve 165F permits the discharge of the hydraulic fluid from the front side chamber 55*f* to the tank 151. The third injection-use valve 165C permits the release of the hydraulic fluid from the accumulator 157 to the rear side chamber 55*e*.

By operations of the various types of valves as described above, the pressure of the injection head side chamber 55*h* is raised by the boosting piston 59 and the injection pressure rises. Then, the injection pressure reaches the final pressure. Further, the injection speed becomes zero by complete filling of the molten metal in the cavity 105.

After that, the control device 9 maintains the state where the injection pressure has become the final pressure. That is, the holding process is carried out. For example, the various types of valves are maintained in the states at the time of the boosting process described above. During the holding process, the molten metal is cooled and solidified. When the molten metal solidifies, the control device 9 closes the third injection-use valve 165C and ends application of the liquid pressure from the accumulator 157 to the rear side chamber 55*e* and so on thereby ending the holding process.

Note that, the control device 9 suitably judges whether the molten metal has solidified. For example, the control device 9 judges whether the molten metal has solidified according to whether a predetermined time has passed from a predetermined point of time such as the point of time when the final pressure was obtained.

(Operation of Detachable Portion in High Speed Injection Process to Holding Process)

As explained above, when high speed injection is started, the plunger 49 and injection piston rod 61 move forward while leaving the detachable portions 71 behind. On the other hand, even after the start of the high speed injection, the forward movement of the detachable portions 71 by the injection-use electric motors 69 is continued. After that, the boosting starts and the speed of the plunger 49 falls and further the holding action is started and the plunger 49 stops, whereby the detachable portions 71 (base 91) catch up with the abutted portions 67*b*. In other words, the detachable portions 71 become states where they can engage with the abutted portions 67*b*. The point of time when the detachable portions 71 reach the abutted portions 67*b* is preferably before the completion of the holding action.

The control device 9 stops the injection-use electric motor 69 when detecting the arrival of the detachable portions 71 at the abutted portions 67*b* based on the detection values of the position sensor 169 and encoder 69*e*. Note that, the positions of the detachable portions 71 may be detected by providing a position sensor (linear encoder) the same as the position sensor 169 and so on.

The speed of the detachable portions 71 from the start of the high speed injection up to the arrival of the detachable portions 71 at the abutted portions 67*b* may be the same as the speed at the time of the low speed injection or may be different from the latter. Further, the deceleration control may be suitably carried out as well so that the base 91 does not strike the plunger 49.

(Die Opening Initial Step)

After ending of the holding action, the control device 9 switches the clamping-use valve 161 to connect the clamping rod side chamber 33*r* and the tank 151 and connect the clamping head side chamber 33*h* and the pump 153. Due to this, the clamping cylinders 21 are depressurized and the extension of the tie bars 17 is canceled. After that, the control device 9 for example switches the clamping-use valve 161 so as to prohibit the flow of the hydraulic fluid relating to the clamping cylinders 21.

Next, the control device 9 drives the die opening/closing-use electric motor 25 and moves the movable die plate 15 to the die opening direction. Due to this, the moving die 103 is separated from the fixed die 101 together with the molded article.

At this time, the control device 9 performs control for ejecting the biscuit by the plunger 49 along with the movement of the moving die 103, that is, what may be called a "tracking ejection" action. For example, the control device 9 drives the pump-use electric motor 155 and sends out the hydraulic fluid from the pump 153, controls the first injection-use valve 165A so as to permit the flow of the hydraulic fluid from the pump 153 to the head side chamber 55*h*, and controls the fourth injection-use valve 165D and fifth injection-use valve 165E so as to permit the flow of the hydraulic fluid from the injection rod side chamber 55*r* to the tank 151. After that, when the plunger 49 moves up to a predetermined position, the control device 9 controls the above-described valves so as to prohibit the flow of the hydraulic fluid relating to the injection cylinder 51 and ends the ejection tracking action. Note that, the tracking ejection action may be carried out by driving the plunger 49 by the injection-use driving device 53 or may be carried out by driving the plunger 49 as a whole or partially by both of the injection cylinder 51 and the injection-use driving device 53.

(Die Opening Process)

Even after the end of the tracking ejection action, the control device 9 continues the movement of the movable die plate 15 by the die opening/closing-use electric motor 25 in the die opening direction. Then, when the movable die plate 15 reaches the predetermined die opening position, the control device 9 stops the die opening/closing-use electric motor 25 and ends the die opening process.

Note that, the die opening position is generally made the die open limit (driving limit on the die opening side) of the movable die plate 15. Note, the electrically operated die opening/closing-use driving devices 19 can easily hold the position of the movable die plate 15 at any position, therefore the die opening position may be made nearer the die closing side than the die open limit. In this case, the time required for opening and closing the die can be shortened.

The control device 9 fills the accumulator 157 parallel to the opening of the dies. That is, the control device 9 drives the pump-use electric motor 155 and controls the filling-use valve 167 so as to permit the flow of the hydraulic fluid from the pump 153 to the accumulator 157. After that, when the detection value of the not shown pressure sensor detecting the pressure of the accumulator 157 reaches a predetermined value, the control device 9 closes the filling-use valve 167 and so on and ends the filling of the accumulator 157.

(Core Return and Injection Return)

For example, when the die opening and filling of the accumulator 157 are completed, the control device 9 performs control for retracting the core 107 from the space between the fixed die 101 and the moving die 103 (core return). For example, the control device 9 drives the pump-use electric motor 155 and switches the core-use valve 163 to permit the flow of the hydraulic fluid from the pump 153 to the core rod side chamber 41*r* and permit the flow from the core head side chamber 41*h* to the tank 151. When the core 107 ends the retraction, for example, the control device 9 switches the core-use valve 163 so as to prohibit the flow of the hydraulic fluid according to the core cylinder 39.

Further, the control device 9 performs control for retracting the plunger 49 (injection return) parallel to the core return. For example, the control device 9 sets the hooks 93 of the detachable portions 71 to the ON position to engage them with the plunger 49. Note that, this engagement may be carried out at any timing so far as the detachable portions 71 have caught up with the plunger 49. Then, the control device 9 drives the injection-use electric motors 69 to retract the plunger 49. That is, the injection return is carried out not by the injection cylinder 51, but by the injection-use driving device 53.

Note that, during a period where the injection return is carried out by the injection-use driving device 53, for example, the injection cylinder 51 is brought to a state where the drive force is not generated and is returned to the initial state by the drive force of the injection-use driving device 53.

For example, the control device 9 controls the fourth injection-use valve 165D and fifth injection-use valve 165E so as to permit the flow of the hydraulic fluid from the tank 151 to the injection rod side chamber 55*r*, controls the first injection-use valve 165A so as to prohibit the discharge of the hydraulic fluid from the injection head side chamber 55*h*, controls the sixth injection-use valve 165F so as to permit the flow of the hydraulic fluid from the tank 151 to the front side chamber 55*f*, and controls a not shown valve so as to permit the discharge of the hydraulic fluid from the rear side chamber 55*e* to the tank 151 (the passage for this purpose is not shown). Due to this, along with the retraction of the plunger 49, the injection piston 57 and the booster piston 59 retract. When the booster piston 59 reaches the backward limit, the first injection-use valve 165A is controlled so as to permit the discharge of the hydraulic fluid from the injection head side chamber 55*h* to the tank 151, and the retraction of the injection piston 57 is continued.

After that, when the plunger 49 reaches the backward limit, the control device 9 stops the injection-use electric motor 69 and prohibits the flow of the hydraulic fluid relating to the injection cylinder 51.

(Ejection Process and Extraction Process)

When the core return and injection return are completed, the control device 9 drives a not shown ejection device to eject the molded article from the moving die 103. Then, a not shown conveyor device takes out the ejected molded article from the clamping device 3 (dies). The not shown ejection device is for example driven by supply of the hydraulic fluid from the pump 153 to an ejection cylinder which is included in the ejection device.

As described above, in the present embodiment, the die casting machine 1 has the clamping device 3 and the injection device 5. The clamping device 3 has the electrically operated die opening/closing-use driving devices 19 which move the movable die plate 15 in the die opening and closing direction and has the clamping cylinders 21 which generate the clamping force and is a 2-platen type. The injection device 5 has the electrically operated injection-use driving device 53 which drives the plunger 49 in the low speed injection and the injection cylinder 51 which drives the plunger 49 in the high speed injection.

Accordingly, the die casting machine 1 as a whole suitably utilizes the hydraulic cylinders and electric motors. Specifically, for example, the electrically operated driving devices are used for both of the clamping device 3 and the injection device 5, therefore the instances where the electric motors drive the pump to send out the hydraulic fluid can be reduced in the die casting machine 1 as a whole. The electrically operated driving devices directly transmit the drive force without using hydraulic fluid, therefore are efficient, and the consumed power is reduced in the die casting machine 1 as a whole. On the other hand, by utilizing the hydraulic cylinders for the clamping needing a large power and for the high speed injection needing a high speed, the quality of the molded article can be improved. Also by stabilization of the control of the speed of the low speed injection by the electrically operated injection-use driving device 53, an improvement of quality of the molded article is expected. A hybrid type injection device 5 needs space for arrangement of the injection-use driving device 53 compared with a full hydraulic type injection device. However, if the injection-use driving device 53 is arranged on the lateral side of the injection cylinder 51, the increase in length and increase in size of the die casting machine 1 are reduced. Rather, due to the clamping device 3 being a 2-platen type, the die casting machine 1 can be made shorter as a whole. That is, the arrangement space can be made smaller.

Further, in the present embodiment, the die casting machine 1 has the liquid pressure unit 7. The liquid pressure unit 7 has the tank 151 for storing the hydraulic fluid, the pump 153 which sends out the hydraulic fluid from the tank 151, the plurality of valves which control the flow of the hydraulic fluid, and the holding base 159 which holds these and the unit supplies the hydraulic fluid to both of the clamping cylinders 21 and the injection cylinder 51.

Accordingly, the clamping device 3 and the injection device 5 are integrated or standardized in parts of the hydraulic systems, so space is saved. Since the clamping device 3 does not have hydraulic cylinders for opening and closing the dies, so compared with the full hydraulic type clamping device, the amount of the hydraulic fluid used, the frequency of use of the pump, and the number of valves are smaller. Accordingly, even when parts of the hydraulic systems are integrated, extreme enlargement of the tank 151, the use of the pump-use electric motor 155 under extremely severe conditions, and extreme enlargement of the holding base 159 are prevented. As a result, the concerned increase of costs of these parts is reduced.

Further, in the present embodiment, the clamping device 3 further has the core cylinder 39 which advances and retracts the core 107 to and from the space between the fixed die 101 and the moving die 103. In each molding cycle, the retraction of the core 107 by the core cylinder 39 and the die-opening by the injection-use driving device 53 are simultaneously carried out.

Accordingly, the cycle time is shortened. Specifically, this is as follows. A spray process of coating a mold releasing agent is carried out after the die-opening and core return. At this time, in general, to prevent the mold releasing agent from entering into the sleeve 47, the plunger 49 is not retracted but stands by at the position in front of the sleeve 47 until the spray process ends. Accordingly, the core return and the injection return are not simultaneously carried out. Further, in the full hydraulic type die casting machine, if the core return and the injection return are simultaneously carried out, the hydraulic fluid must be supplied from the pump 153 to both of the core cylinder 39 and the injection cylinder 51. As a result, in the full hydraulic type die casting machine, even when trying to simultaneously perform the core return and the injection return, the hydraulic fluid flows to only the one of the core cylinder 39 or injection cylinder 51 which has a lower pressure. In the end, the operations are carried out in succession or the speeds of the two fall. That is, the effect of shortening the cycle time is not obtained. In the present embodiment, however, the core return and the injection return are simultaneously carried out by different driving sources, therefore the cycle time is shortened.

Note that, either of the core return or injection return may be started earlier. Further, either may be completed earlier as well. So far as at least a portion of the period of either of the core return or injection return and at least a portion of the other period overlap each other, the cycle time is shortened.

Further, in the present embodiment, the die casting machine 1 further has the accumulator 157 which supplies the hydraulic fluid to the injection cylinder 51. In each molding cycle, the die-opening by the die opening/closing-use driving devices 19 and filling of the accumulator 157 are simultaneously carried out.

Accordingly, the cycle time is shortened. Note that, in the full hydraulic type die casting machine, even if trying to simultaneously perform the die-opening and filling, the hydraulic fluid flows to only the one of the die opening/closing-use hydraulic cylinder or accumulator 157 which has the lower pressure. In the end, the die-opening and filling are carried out in succession or the speeds of the two fall. That is, the effect of shortening the cycle time is not obtained.

Note that, either of the die-opening or filling of the accumulator may be started earlier, and either may be completed earlier. So far as at least a portion of the period of either of the die-opening or filling of the accumulator and at least a portion of the other period overlap each other, the cycle time is shortened.

Second Embodiment

Figure 6:
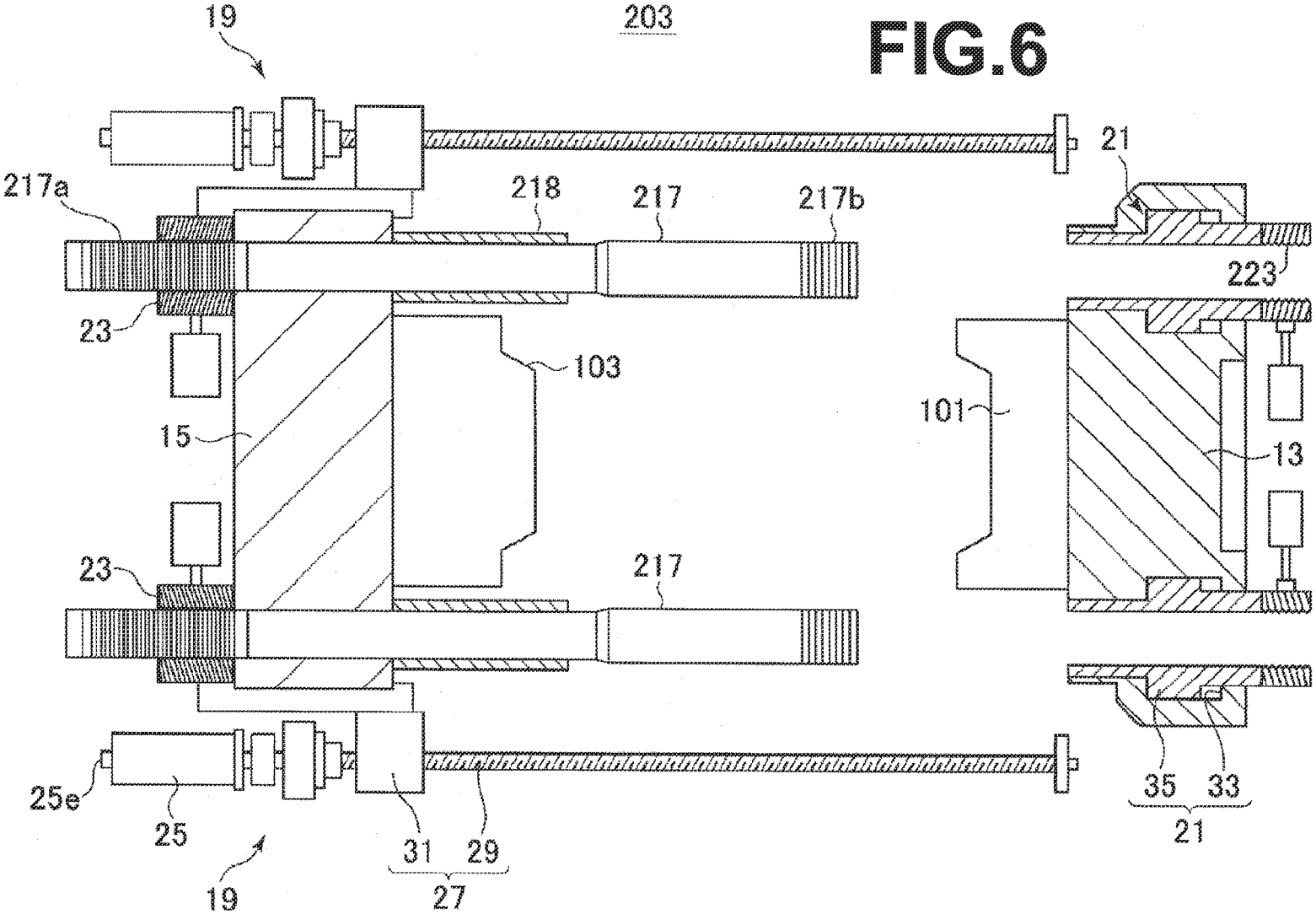
FIG. 6 is a plan view which schematically shows a configuration of principal parts of a clamping device of a die casting machine according to a second embodiment of the present invention

FIG. 6 is a plan view schematically showing a configuration of principal parts of a clamping device 203 of a die casting machine according to a second embodiment of the present invention.

Although not particularly shown, in the second embodiment, configurations other than the clamping device 3 are the same as those in the first embodiment. Further, in the clamping device 203 in the second embodiment, configurations which are the same as or resemble those of the clamping device 3 in the first embodiment will be assigned the same notations as the notations in the first embodiment and explanations will be omitted.

The clamping device 203 differs from the clamping device 3 in the first embodiment in the point that a plurality of tie bars 217 can be pulled out of the fixed die plate 13 by the movable die plate 15. Specifically, this is as follows.

The clamping device 203 has fixed side engagement devices 223 capable of connecting the clamping pistons 35 and the tie bars 217 and releasing the connections. The fixed side engagement devices 223 are configured including half nuts or other split nuts and are connected with respect to the clamping pistons 35 so that they cannot move in the die opening and closing direction.

In the tie bars 217, in the same way as the first embodiment, engaged portions 217*a* which engage with engagement devices 23 are formed at ends on the movable die plate 15 side. Further, in the tie bars 217, ends on the fixed die plate 13 side are formed with fixed side engaged portions 217*b* which engage with the fixed side engagement devices 223.

Accordingly, by engaging the fixed side engagement devices 223 with the fixed side engaged portions 217*b* all the time in the molding cycle, the same operation as that of the clamping device 3 in the first embodiment becomes possible.

Further, at the time of exchange of the dies, the movable die plate 15 is moved in the die-closing direction (for example moved up to the die contact position). Next, the engagement devices 23 are engaged with the engaged portions 217*a*, and the engagement between the fixed side engagement devices 223 and the fixed side engaged portions 217*b* is released. After that, the movable die plate 15 is moved to the die-opening direction, whereby the tie bars 217 can be pulled out of the fixed die plate 13.

Note that, the base 11 and the die opening/closing-use driving devices 19 etc. must be configured longer than those in the first embodiment so that it is possible to move the movable die plate 15 in the die-opening direction more than the die open position of the molding cycle. Further, the movable die plate 15 has cylindrical guide members 218 which extend to the die-opening direction from the front face thereof so that the pulled-out tie bars 217 can be suitably supported.

According to the above second embodiment, the die casting machine has a 2-platen type composite type clamping device 203 and a hybrid type injection device 5, therefore the same effects as those in the first embodiment are exhibited. Further, it is not necessary to provide large-scale equipment for pulling out the tie bars 217, therefore space is further saved.

Example

A die casting machine according to the embodiments was fabricated, and the consumed power in the molding cycle was measured. Further, as a comparative example, the consumed power in the molding cycle of a full hydraulic type die casting machine was measured. Note, the molding cycles were for experiments. Molten metal was not supplied to the sleeves 47.

The measurement conditions of the consumed power will be shown next.

Cycle time: Four kinds of 25, 30, 35, and 40 seconds

Pressure when filling accumulator: 13.5 MPa

Dies: None

Extrusion: Drive hydraulic cylinder for extrusion by full stroke

Stroke of high speed injection: About ⅓ of full stroke of injection cylinder

Temperature of oil as hydraulic fluid: About 40° C.

The measurement results of the consumed power will be shown below. Note that, the consumed powers which are shown below are the consumed powers in only the machine bodies, and the consumed powers concerned with the advance and retraction of the core, supply of hot metal, and spraying are excluded. Further, "REDUCTION RATE" is (consumed power in comparative example−consumed power in example)/(consumed power in comparative example)×100(%).

| Cycle time (s) | Comparative Example (kW) | Example (kW) | Reduction rate (%) |
|---|---|---|---|
| 25 | 16.0 | 8.5 | 46.8 |
| 30 | 15.9 | 7.4 | 53.4 |
| 35 | 15.5 | 6.8 | 56.1 |
| 40 | 15.1 | 6.0 | 60.2 |

As described above, in the example, compared with the comparative example, the consumed power is reduced by roughly 40 to 60%.

Figure 7A:
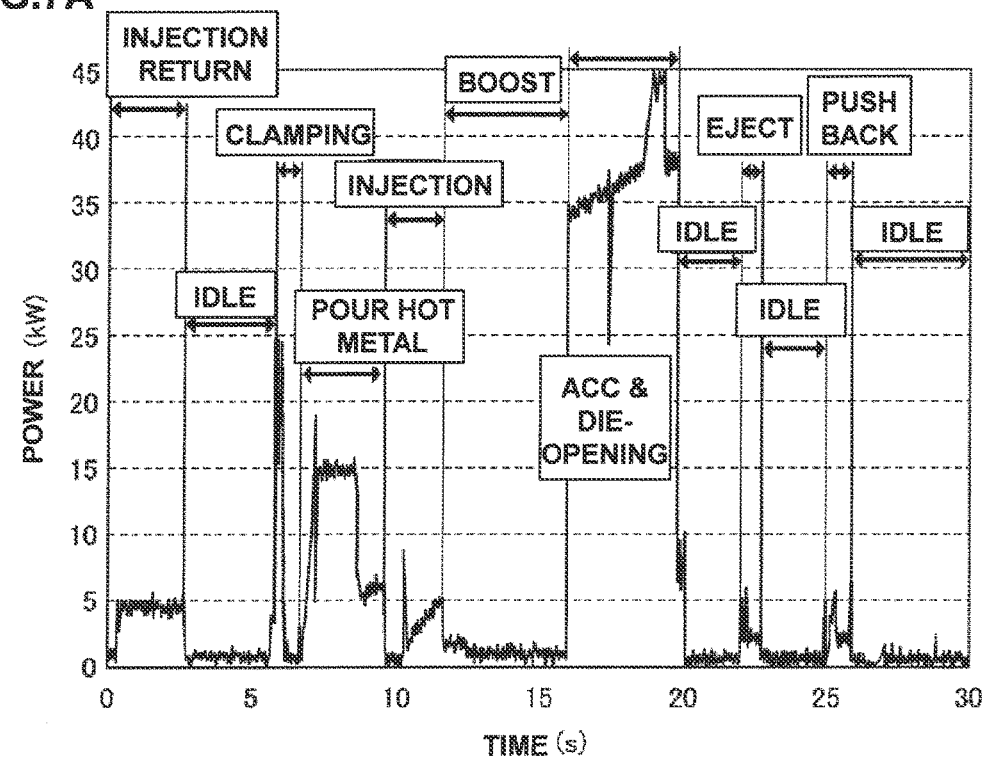
FIG. 7A and FIG. 7B are diagrams which show consumed powers of die casting machines according to an example and a comparative example.
Figure 7B:
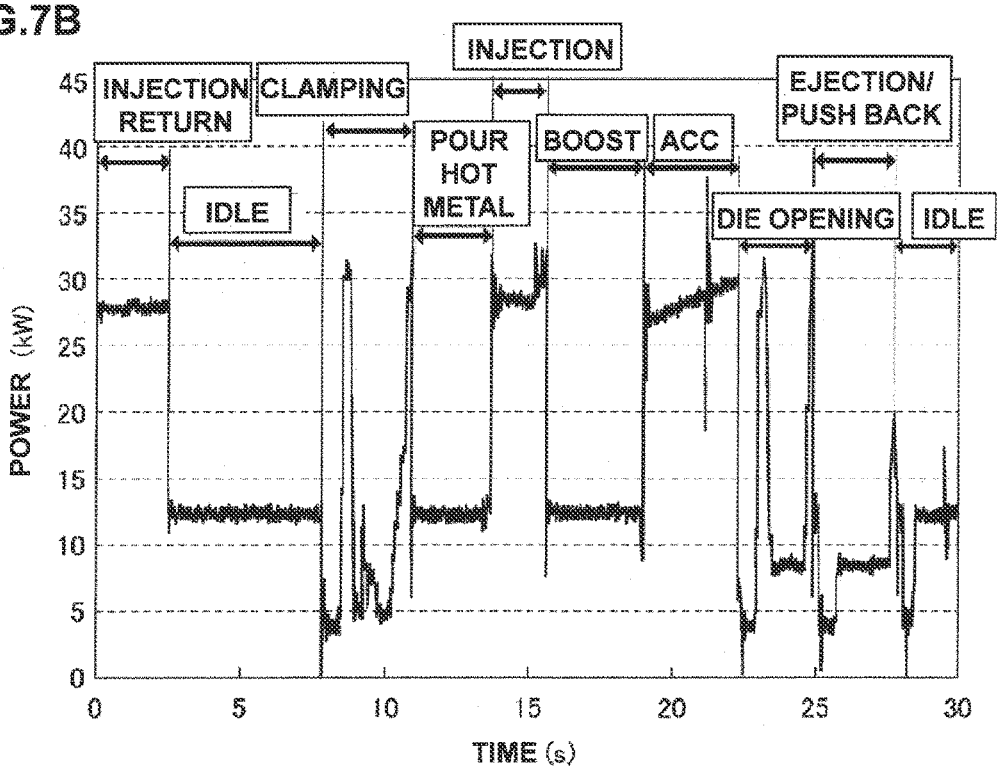

FIG. 7A shows the measurement results of consumed power in the example, and FIG. 7B shows the measurement results of consumed power in the comparative example. All are values at the time when the cycle time is 30 s. As shown in this table, in the injection return or die-closing (included in "CLAMPING" in this diagram) or the like wherein the drive force of the electric motor is directly transmitted without using hydraulic fluid, the consumed power is effectively reduced.

Further, other than the consumed power, in the example, compared with the comparative example, the following effects were confirmed.

Arrangement space of machine: Reduced by about 30%

Productivity: Increased by 10 to 30% (since overlap operation is possible or the like)

Used hydraulic fluid: Reduced by about 80% (tank capacity becomes about ⅕)

Improvement of casting quality/reduction of defect rate (since stabilization of low speed injection speed or the like)

The present invention is not limited to the above embodiments and may be executed in various aspects.

The molding machine is not limited to a die casting machine. For example, the molding machine may be another metal molding machine, may be an injection molding machine which molds resin, or may be a molding machine which molds a material obtained by mixing a thermoplastic resin or the like with sawdust. Further, the molding machine is not limited to a horizontal clamping/horizontal injection type. For example, it may be a vertical clamping/vertical injection, vertical clamping/horizontal injection, or horizontal clamping/vertical injection type. The molding machine may be one without an injection frame as well. The hydraulic fluid is not limited to oil and may be for example water.

In the molding machine, the liquid pressure unit which combines parts of the hydraulic systems relating to the clamping device and the injection device need not be provided either. The core may be driven by an electrically operated driving device as well.

The die opening and closing-use driving devices has only to be electrically operated types and are not limited to ones which convert the rotation of rotary electric motors to translational motion by screw mechanisms. For example, the die opening and closing-use electric motors are not limited to rotating types and may be linear motors as well. Further, for example, the mechanisms of converting the rotation of the die opening and closing-use electric motors to translational motion are not limited to screw mechanisms and may be for example rack and pinion mechanisms as well. Further, for example, in the die opening and closing-use driving devices, the transmission routes of drive force may be provided with suitable gear mechanisms or pulleys and belts mechanisms as well.

The injection device has only to be hybrid type and is not limited to one which attaches/detaches an electrically operated injection-use driving device to/from a plunger (injection piston rod). For example, the injection device may be one which moves a cylinder member of an injection cylinder by an electrically operated injection-use driving device or may be one which uses an electrically operated injection-use driving device to move a press member inserted into the cylinder member of the injection cylinder from the back and presses (pressurizes) the injection piston or the hydraulic fluid behind this by the press member described before.

Further, in a case where the drive force of an electrically operated injection-use driving device is transmitted to the plunger (injection piston rod) outside the injection cylinder member as in the embodiments, the injection device need not be provided with detachable portion either if the relative forward movement of the movable member (for example the base 91) of the injection-use driving device with respect to the plunger is restricted. For example, the hooks 93 and actuators 95 in the embodiments need not be provided either. Note that, in this case, retraction of the plunger is carried out by the injection cylinder. Further, when detachable portion is provided, the detachable portion is not limited to one utilizing engagement and may be one using frictional force or one using magnetic force.

Further, the injection-use driving device has only to be electrically operated and is not limited to one converting the rotation of a rotary electric motor to translational motion by a screw mechanism. For example, the injection-use electric motor is not limited to a rotating type and may be a linear motor as well. Further, for example, the mechanism for converting the rotation of the injection-use electric motor to translational motion is not limited to a screw mechanism and may be for example a rack and pinion mechanism as well. Further, the transmission mechanism for transmitting the rotation of the injection-use electric motor is not limited to a pulley and belt mechanism and may be a gear mechanism or the transmission mechanism may be omitted.

The liquid pressure unit may be configured by including suitable portions among a plurality of elements of the hydraulic system which are necessary for the clamping device and injection device etc. For example, in the embodiments, the case where all valves relating to the clamping device and injection device were included in the liquid pressure unit was exemplified, but part of the valves may be provided separately from the liquid pressure unit as well. Further, for example, the accumulator may be provided separately from the liquid pressure unit and may be provided above the injection cylinder as well.

The configuration of the hydraulic system shown in the embodiments is only one example. the arrangement of the passages and valves may be suitably changed. For example, the run-around circuit connecting the injection rod side chamber and the injection head side chamber need not be provided either. Further, for example, in place of or in addition to the servo valve configuring the meter-out circuit, a servo valve configuring a meter-in circuit may be provided as well.

The operation shown in the embodiments may be suitably changed. For example, in the embodiments, the case where the core return and the injection return were simultaneously carried out was exemplified. However, in the same way as a general operation, the die-opening and core return, spraying, and injection return may be carried out in that order. Further, for example, the die-opening and the filling of the accumulator need not be carried out parallel. Further, for example, the injection-use driving device may be utilized also for the boosting process. The injection return may be carried out by the drive force of the injection cylinder as well.

Note that, from the present application, for example, the following inventions can be extracted: An invention of a molding machine having a composite type clamping device and hybrid type injection device, having a liquid pressure unit capable of supplying a hydraulic fluid to the clamping device and the injection device. An invention wherein retraction of a core by a core cylinder and retraction of a plunger by an electrically operated injection-use driving device are simultaneously carried out. An invention wherein, in each molding cycle, die-opening by an electrically operated die opening and closing-use driving device and filling of an accumulator for injection cylinder are simultaneously carried out. In these inventions, suitable changes may be made within the scope where the inventions stand. For example, the clamping device or injection device may be changed to a fully electrically operating type or full hydraulic type, or the clamping device may be changed to a toggle type.

A priority is claimed on Japanese application No. 2014-136608 filed on Jul. 2, 2014, the contents of which are incorporated herein by reference.

REFERENCE SIGNS LIST

1 . . . die casting machine, 3 . . . clamping device, 5 . . . injection device, 13 . . . fixed die plate, 15 . . . movable die plate, 19 . . . die opening/closing-use driving device, 21 . . . clamping cylinder, 47 . . . sleeve, 49 . . . plunger, 51 . . . injection cylinder, 53 . . . injection-use driving device, 101 . . . fixed die, 103 . . . moving die, and 105 . . . cavity.

The invention claimed is:

1. A molding apparatus comprising:

a clamping device which includes:

a fixed die plate which holds a fixed die;

a movable die plate which holds a moving die;

a core cylinder that makes a core advance or retract to or from a space between the fixed die and the moving die;

an electrically operated die opening and closing-use driving device which moves the movable die plate in an opening and closing direction; and a clamping cylinder which generates a clamping force; and an injection device which includes:

a plunger which is capable of sliding in a sleeve;

an electrically operated injection-use driving device which drives the plunger at least at the time of low speed injection; and an injection cylinder which drives the plunger at least at the time of high speed injection; and a control device controlling the core cylinder and the injection-use driving device so that the retraction of the core by the core cylinder and the retraction of the plunger by the injection-use driving device are simultaneously carried out in each molding cycle;

wherein the injection-use driving device comprises:

a rotary electric motor;

a screw shaft which is parallel to the plunger and is rotated around its axis by the rotary electric motor;

a nut which is screwed with the screw shaft and is moved parallel to the plunger by rotation of the screw shaft;

a guide shaft which is parallel to the plunger and is fixed at its rear end to the nut; and a movable member which is fixed to a front of the guide shaft, the relative forward movement of the movable member with respect to the plunger being restricted.

2. The molding apparatus according to claim 1 further comprising a liquid pressure unit which has a tank for storing a hydraulic fluid, a pump for sending out the hydraulic fluid from the tank, a plurality of valves for controlling the flow of the hydraulic fluid, and a holding base for holding the tank, the pump, and the plurality of valves, wherein the liquid pressure unit supplies the hydraulic fluid to both of the clamping cylinder and the injection cylinder.

3. A molding apparatus comprising:

a clamping device which includes:

a fixed die plate which holds a fixed die;

a movable die plate which holds a moving die;

an electrically operated die opening and closing-use driving device which moves the movable die plate in an opening and closing direction; and a clamping cylinder which generates a clamping force; and an injection device which includes:

a plunger which is capable of sliding in a sleeve;

an electrically operated injection-use driving device which drives the plunger at least at the time of low speed injection; and an injection cylinder which drives the plunger at least at the time of high speed injection;

an accumulator that supplies hydraulic fluid to the injection cylinder; and a control device controlling the die opening and closing-use driving device and the accumulator device so that die-opening by the die opening and closing-use driving device and filling of the accumulator are simultaneously carried out in each molding cycle;

wherein the injection-use driving device comprises:

a rotary electric motor;

a screw shaft which is parallel to the plunger and is rotated around its axis by the rotary electric motor;

a nut which is screwed with the screw shaft and is moved parallel to the plunger by rotation of the screw shaft;

a guide shaft which is parallel to the plunger and is fixed at its rear end to the nut; and a movable member which is fixed to a front of the guide shaft, the relative forward movement of the movable member with respect to the plunger being restricted.

4. The molding apparatus according to claim 3 further comprising a liquid pressure unit which has a tank for storing a hydraulic fluid, a pump for sending out the hydraulic fluid from the tank, a plurality of valves for controlling the flow of the hydraulic fluid, and a holding base for holding the tank, the pump, and the plurality of valves, wherein the liquid pressure unit supplies the hydraulic fluid to both of the clamping cylinder and the injection cylinder.

* * * * *